US005882832A

United States Patent [19]

Tosaka et al.

[11] Patent Number: 5,882,832

[45] Date of Patent: Mar. 16, 1999

[54] ONE COMPONENT DEVELOPER DEVELOPING METHOD AND DRY TONER THEREFOR

[75] Inventors: Hachiroh Tosaka, Shizuoka-ken; Shoichi Sugimoto, Numazu; Masahide Yamashita, Numazu; Shinichiroh Yagi, Numazu, all of Japan

[73] Assignee: Ricoh Company, Ltd., Tokyo, Japan

[21] Appl. No.: 840,222

[22] Filed: Apr. 11, 1997

[30] Foreign Application Priority Data

Apr. 30, 1996 [JP] Japan ..... 8-132732
Jul. 16, 1996 [JP] Japan ..... 8-205404

[51] Int. Cl.[6] ..... G03G 9/04

[52] U.S. Cl. ..... 430/106; 430/110; 430/903

[58] Field of Search ..... 430/903, 106, 430/110

[56] References Cited

U.S. PATENT DOCUMENTS

| | | | |
|---|---|---|---|
| 4,670,368 | 6/1987 | Tosaka et al. | 430/106.6 |
| 4,762,763 | 8/1988 | Nomura et al. | 430/110 |
| 5,164,774 | 11/1992 | Tomita et al. | 355/245 |
| 5,637,430 | 6/1997 | Shimizu et al. | 430/903 |
| 5,663,026 | 9/1997 | Kasuya et al. | 430/106.6 |
| 5,665,512 | 9/1997 | Tsutsui et al. | 430/903 |

*Primary Examiner*—John Goodrow
*Attorney, Agent, or Firm*—Cooper & Dunham LLP

[57] ABSTRACT

A dry toner useful for one component developer developing method is provided which has good image qualities and durability without contamination of developing apparatus. The toner includes a metal oxide in an amount of from about 10 to about 30 parts by weight per 100 parts by weight of the toner and a metal-containing azo dye.

18 Claims, 1 Drawing Sheet

ONE COMPONENT DEVELOPER DEVELOPING METHOD AND DRY TONER THEREFOR

BACKGROUND OF THE INVENTION

1. Field of the Invention

The present invention relates to an image forming method and dry toner useful for developing an electrostatic latent image formed by electrography, electrostatic recording, electrostatic printing or the like.

2. Discussion of the Related Art

A variety of methods using electrophotography for obtaining a recorded image have been disclosed in, for example, U.S. Pat. No. 2,297,691 and Japanese Patent Publications No. 49-23910 and 43-24748, incorporated herein by reference. Generally, these methods include the following steps:

(a) an electrostatic latent image is formed on a photoconductor by various methods;

(b) the electrostatic latent image is developed with toner;

(c) the developed toner image is transferred to a recording material such as paper or the like; and (d) the transferred toner image is fixed by application of heat, pressure or organic solvent vapor to obtain a recorded image.

Methods of developing an electrostatic latent image are broadly classified into two types. The first type of the developing methods is a liquid toner developing method using liquid toner which is made by dispersing a pigment and/or a dye in an insulating organic liquid. The second type of the developing methods is a dry toner developing method which uses dry toner made by dispersing a coloring agent, such as carbon black or the like, in a binder resin, such as natural resins or synthetic resins. Currently, the dry toner developing method is widely used for electrophotography.

Further the dry toner developing method is broadly classified into two types. The first type of the dry toner developing method is a one component developer developing method using a one component developer (i.e., toner) in which, for example, both a coloring agent and a magnetizable substance are dispersed in a binder resin. The second type of the dry toner developing method is a two component developer developing method using a two component developer which includes a mixture of dry toner and a magnetizable carrier, such as iron powder or the like.

Between these two methods, the one component developer developing method is widely used for electrophotography because of the following advantages:

(1) an image forming apparatus using the one component developing method needs not have a toner concentration controlling device and therefore a cost efficient image forming apparatus can be manufactured;

(2) a developing unit using the one component developing method needs only a small agitating device and therefore a compact image forming apparatus can be manufactured; and (3) life of the one component developer is relatively long.

Further, the one component developer developing methods are broadly classified into two types. The first type of the one component developer developing methods is a one component magnetic developer developing method using one component magnetizable developer in which an electrostatic latent image is developed with one component magnetizable developer held on a magnetic developing roller. The second type of the one component developer developing method is a one component non-magnetic developer developing method in which an electrostatic latent image is developed with one component non-magnetizable developer which is supplied onto a non-magnetic developing roller by a toner supplying member.

In one component developer developing methods of both magnetic and non-magnetic developer developing types, when a developer (hereinafter referred to as toner) adheres on a toner carrying member in a developing unit and a toner film is formed on the toner carrying member, there occurs a problem in which waste toner collected at a cleaning section of the developing unit increases because of adhesion of toner on an area of a photoconductor which corresponds to the background of an image (hereinafter "adhesion of toner on an area of a photoconductor" referred to as "photoconductor fouling"). Since the waste toner does not contribute to the toner image formation, a fixed amount of toner packed in a toner container which is guaranteed to be able to develop more than a fixed number of copy sheets has to be increased, resulting in an increase of manufacturing cost. Therefore, the toner adhesion and the resultant film formation on the toner carrying member should be avoided.

In attempting to solve this problem, a toner film formation preventing method has been proposed in which a toner releasing material, such as fluorine-containing materials and silicone resins, is applied onto a toner contacting element of the toner carrying member. However, the method has the following drawbacks:

(1) fluorine-containing materials tend to be negatively charged when rubbed with toner because of their large negative polarity and therefore toner almost always charges positively and negatively charged toner can hardly be obtained; and (2) silicone resins have too poor durability to be applied to these members.

Therefore, these materials cannot be applied to the carrying member and a need exists for toner which does not adhere on a toner carrying member.

Further, a one component developer developing method can generally induce in toner less friction electricity than a two component developer developing method and accordingly a proper amount of a charge controlling agent is frequently added to the toner. For example, conventional positive charge controlling agents which make toner be charged with positive friction electricity include Nigrosine type oil soluble dyes, quaternary ammonium salts, azine dyes having an alkyl group, basic dyes and lakes thereof. Conventional negative charge controlling agents include metal-containing dyes, such as chrome-containing monoazo complexes, chrome-containing salicylic compounds, zinc salicylate compounds and chrome-containing organic dyes, such as copper Phthalocyanine Green and chrome-containing monoazo dyes.

However, when even the toner including these charge controlling agents adheres on a toner carrying member and toner film formation occurs on the toner carrying member, photoconductor fouling also occurs.

There is known a one component non-magnetic developer developing method in which an latent image formed on an electrostatic latent image carrying member is developed with a thin toner layer formed on a toner carrying member in a developing unit which includes the toner carrying member, and a toner layer regulating member and a toner supplying member in which the toner layer regulating member contacts the toner carrying member. In this one component non-magnetic developer developing method, toner tends to adhere on the toner carrying member and make a toner film thereon more frequently than in the case of the magnetic developer developing method. This is because toner is forced to be supplied to the toner carrying member using the toner supplying member in the one component non-magnetic developer developing method while the toner is supplied to the toner carrying member using a magnetic force of the toner carrying member in the one component magnetic developer developing method.

Japanese Laid-Open Patent Application No. 5-341556 appears to discuss a non-magnetic one component developer developing method which includes a non-magnetic toner carrying member feeding toner to an electrostatic latent image carrying member and a toner layer regulating member forming a toner layer on the non-magnetic toner carrying member wherein a metal oxide is included in the non-magnetic one component toner in an amount of from 20 to 50% by weight. This method improves reproducibility of half tone images but cannot improve toner film formation on the non-magnetic toner carrying member.

Because of these reasons, a need exists for toner for a one component developer developing method which has good image qualities and durability without contamination of developing apparatus such as toner film formation.

SUMMARY OF THE INVENTION

Accordingly, an object of the present invention is to provide a toner for a one component developer developing method which has good image qualities and durability without contamination of developing apparatus such as toner film formation.

Another object of the present invention is to provide a toner for a one component developer developing method without photoconductor fouling and toner scattering.

To achieve such objects of the present invention, the present invention contemplates the provision of a toner including a metal oxide and a metal-containing azo dye. Preferably, the metal oxide is included in the toner in an amount of from about 10 to about 30% by weight (i.e., about 10 to about 30 parts by weight per 100 parts by weight of the toner). The toner of the present invention is useful for a one component developer developing method in which a latent image formed on an electrostatic latent image carrying member is developed with a thin toner layer formed on a toner carrying member in a developing unit which includes the toner carrying member, a toner layer regulating member and a toner supplying member wherein the toner layer regulating member or both of the toner layer regulating member and the toner supplying member contact the toner carrying member.

In another embodiment of the present invention, the metal-including azo dye has the formula (i):

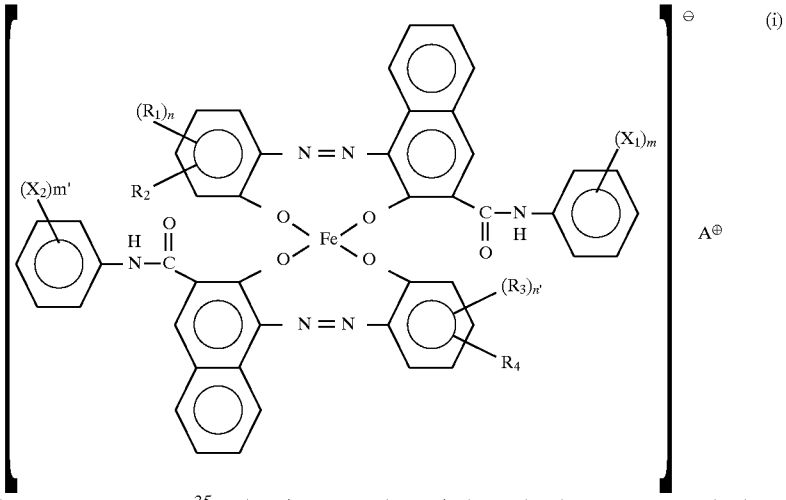

(i)

wherein $X_1$ and $X_2$ independently represent a hydrogen atom, a lower alkyl group, a lower alkoxy group, a nitro group or a halogen atom; m is 1, 2 or 3; m' is 1, 2 or 3; $R_1$ and $R_3$ independently represent a hydrogen atom, an alkyl group having carbon atoms of from 1 to 18, an alkenyl group, a sulfone amide group, a sulfonic acid group, a carboxyl ester group, a hydroxy group, an alkoxy group having carbon atoms of from 1 to 18, an acetyl amino group, a benzoyl amino group or a halogen atom; n is 1, 2 or 3; n' is 1, 2 or 3; $R_2$ and $R_4$ independently represent a hydrogen atom or a nitro group; and $A^+$ represents a hydrogen ion, a sodium ion, a potassium ion or an ammonium ion.

In a yet another embodiment of the present invention, the metal-containing azo dye is included in the toner in an amount of from about 0.1 to about 5.0% by weight, i.e., about 0.1 to about 5.0 parts by weight per 100 parts by weight of the toner.

In a further embodiment of the present invention, the toner has a tablet density of from about 1.20 to about 1.40 g/cm$^3$.

In a still further embodiment of the present invention, the metal oxide includes iron oxide, manganese oxide and ferrite.

In a still further embodiment of the present invention, the toner has a weight-average particle diameter of from about 3 to about 9 $\mu$m.

The toner of the invention also typically includes a binder resin and a coloring agent such as a dye or pigment (and may further contain one of more additives, e.g., additives conventionally used in toners), although in some embodiments the metal oxide itself serves as the coloring agent for the toner and no other coloring agent is present.

The invention also contemplates the provision of a one component developer developing method comprising the steps of providing a toner including a metal oxide and a metal-containing azo dye, providing a developing unit including a toner carrying member, a toner layer regulating member and a toner supplying member wherein the toner layer regulating member contacts the toner carrying member, forming a thin toner layer on the toner carrying member, and developing an electrostatic latent image on an electrostatic latent image carrying member with the thin toner layer to obtain a toner image.

These and other objects, features and advantages of the present invention will become apparent upon consideration of the following description of the preferred embodiments of the present invention taken in conjunction with the accompanying drawing.

DESCRIPTION OF THE PREFERRED EMBODIMENTS

Figure 1:
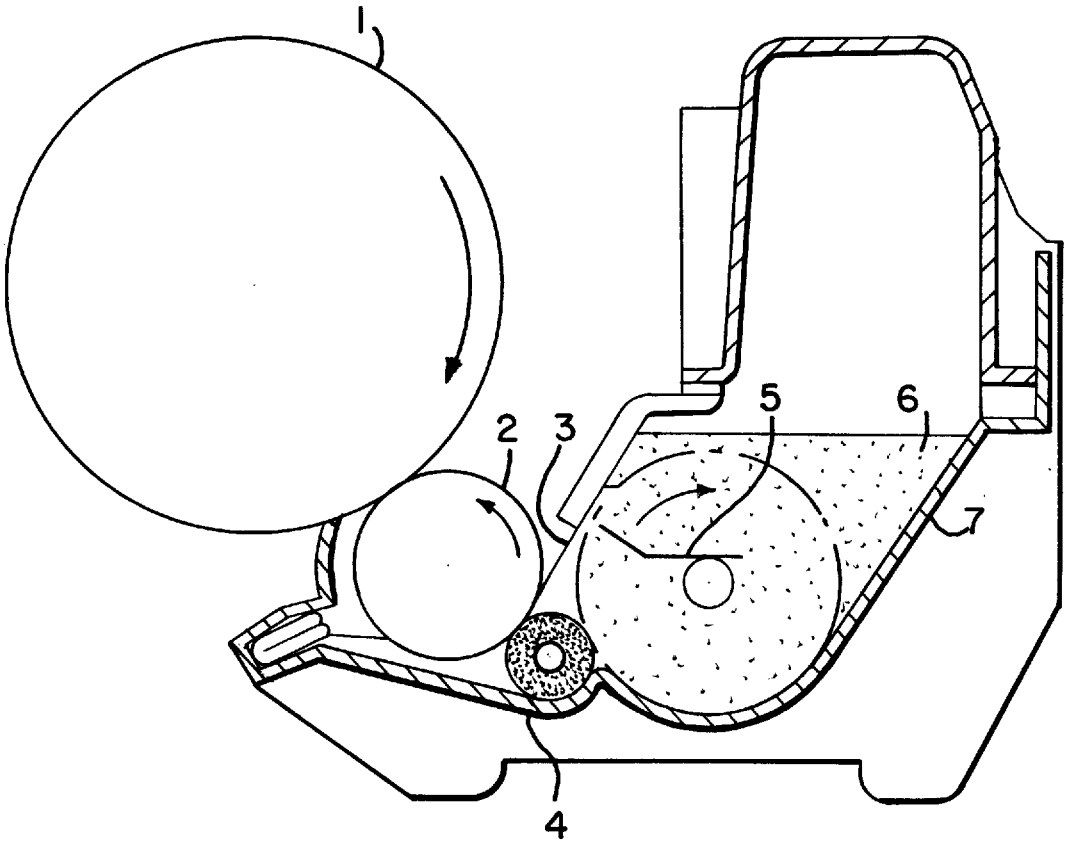
FIG. 1 is a schematic diagram of an embodiment of a developing unit useful for the one component developer developing method of the present invention.

Generally, the present invention provides toner including a metal oxide in an amount of from 10 to 30 parts by weight per 100 parts by weight of the toner and a metal-containing azo dye.

FIG. 1 is a schematic diagram of an embodiment of a developing unit useful for the one component developer developing method of the present invention.

In FIG. 1, one component toner 6 contained in a toner tank 7 is forced to be fed on a sponge roller 4 which is one of toner supplying members by an agitator 5 which is also one of toner supplying members. The toner 6 on the sponge roller 4 is then transferred to a developing roller 2 by rotation of the sponge roller 4 in a direction shown by an arrow. The toner 6 electrostatically and physically adheres to the developing roller 2 by friction with the developing roller 2. The toner 6 adhered to the developing roller 2 is then regulated by an elastic blade 3, i.e., a toner regulating member, to form a charged thin toner layer. The charged thin toner layer contacts or comes close to a surface of a photoconductor drum 1 to develop a latent image on the photoconductor drum 1. Thus, a toner image is formed on the photoconductor drum 1.

In FIG. 1, when the developing roller contacts the photoconductor drum 1 and the sponge roller 4, a toner film tends to be formed on the developing roller 2. Even when the toner of the present invention is used for a developing unit in which the developing roller contacts the photoconductor drum 1 and the sponge roller 4, a toner film is not formed on the developing roller 2.

Suitable metal oxides for use in the toner of the present invention include but are not limited to:

silica, alumina, titanium oxide, calcium titanate, zinc oxide, zirconium oxide, chromium oxide, manganese oxide, iron oxide and ferrite.

These metal oxides may be employed individually or in combination. Among these metal oxides, iron oxide, manganese oxide and ferrite are preferable. Since they are colored black and have a specific gravity greater than 4.0 g/cm$^3$, black colored toner can be obtained without or with little carbon black, resulting in preventing toner from resistance drop causing deterioration of image qualities.

The preferred weight ratio of the metal oxide to the toner in the present invention is from 10 to 30% to prevent the toner carrying member from toner film formation and photoconductor fouling.

Suitable metal-containing azo dyes for use in the toner of the present invention include the known metal-containing dyes which are disclosed, for example, in Japanese Patent Publications No. 2-16916 and 2-28144. Metal-containing azo dyes shown in Table 1 are preferably employed for the toner of the present invention.

The content of the metal-containing azo dye in the toner, which depends on the material of the binder resin used, and the material, the content and the dispersing method of the additives used, may range from 0.1 to 5.0 parts, and more preferably from 0.1 to 2.0 parts by weight per 100 parts, by weight of the toner to prevent the toner carrying member from toner film formation and to maintain good toner transferability and good image qualities.

The toner of the present invention preferably has a tablet density of from about 1.20 to about 1.40 g/cm$^3$ to prevent toner scattering in a developing unit and photoconductor fouling and maintain good image qualities, such as high image density and high resolution.

Measurements of the tablet density of the toner are carried out with the following method:

(1) preparing a cylinder having an inside diameter of 20 mm and a depth of 10 mm, a disk having an outside diameter of 10 mm and a height of 5 mm which can be closely inserted into the cylinder, and a piston having an outside diameter of 10 mm and a length of 80 mm which can also be closely inserted into the cylinder;

(2) inserting the disk into the cylinder;

(3) placing about one gram of toner into the cylinder;

(4) inserting the piston into the cylinder;

(5) pressing the piston for 5 minutes under a pressure of 400 kg/cm$^2$ to obtain a toner tablet;

(6) measuring the diameter (D) and the height (L) of the obtained toner tablet and weighing the weight (W) of the toner tablet; and (7) calculating the tablet density of the toner using the following equation;

$$\text{tablet density (g/cm}^3\text{)} = W/\{\pi(D/2)^2 L\}.$$

Suitable weight-average particle diameter of the toner in the present invention is from 3 to 9 $\mu$m, and more preferably from 5 to 9 $\mu$m to prevent toner film formation and to maintain good image qualities such as high resolution.

Measurements of a weight-average particle diameter in the present invention are carried out with Coulter Counter TA-II.

Suitable manufacturing methods of the toner for use in the present invention include the known manufacturing methods.

TABLE 1
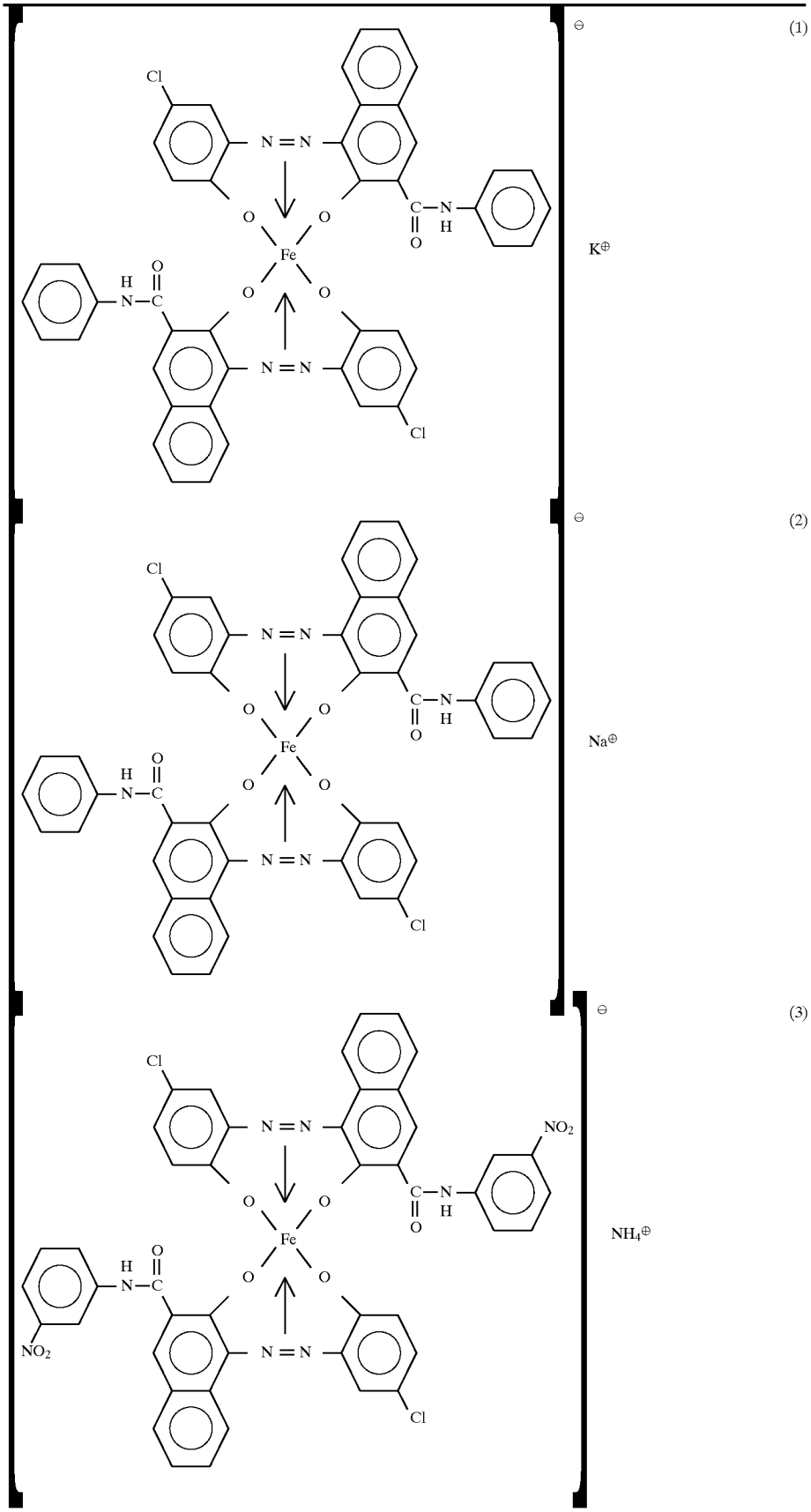

TABLE 1-continued
(4)
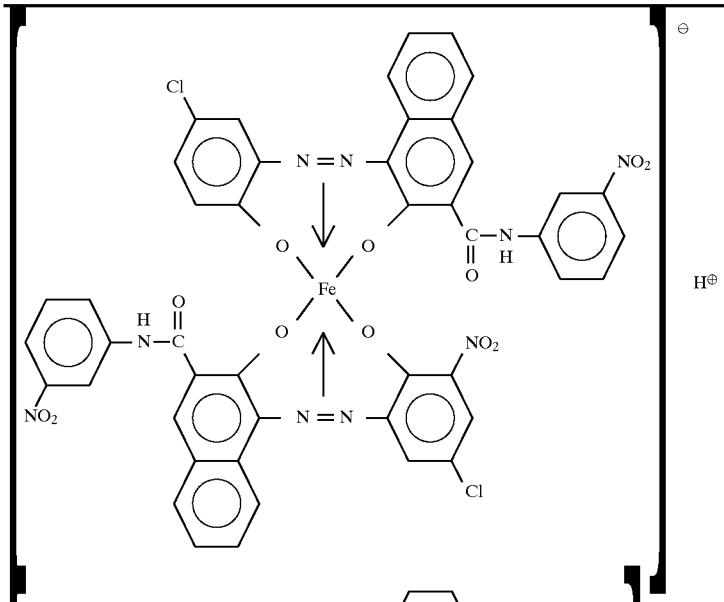
(5)
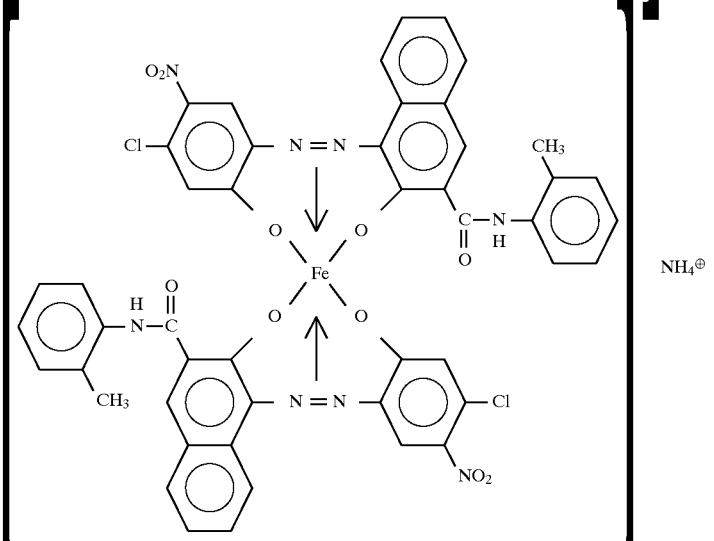
(6)
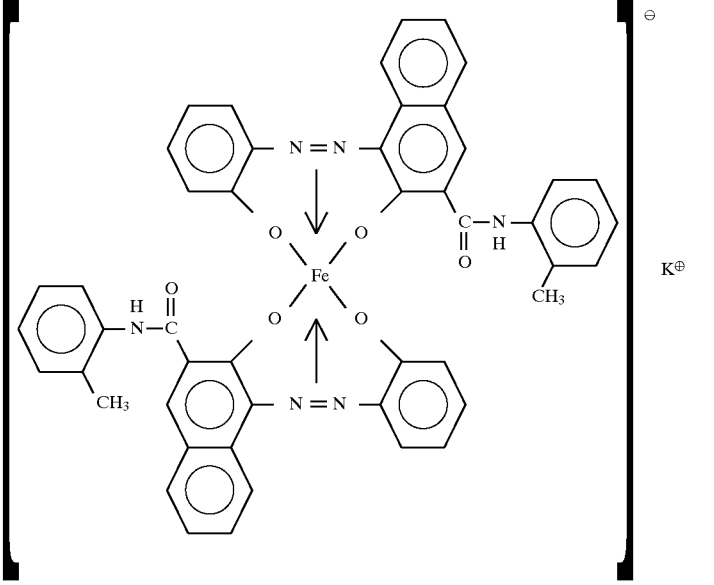

TABLE 1-continued
(7)
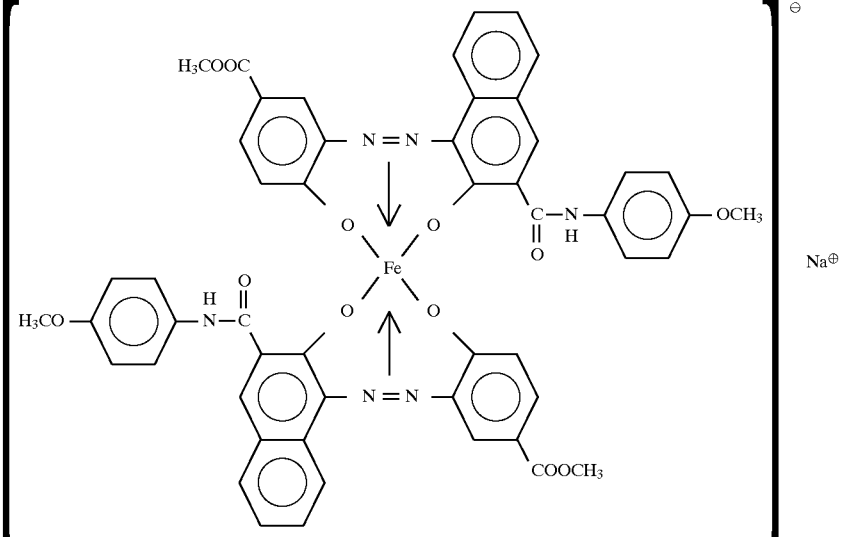
(8)
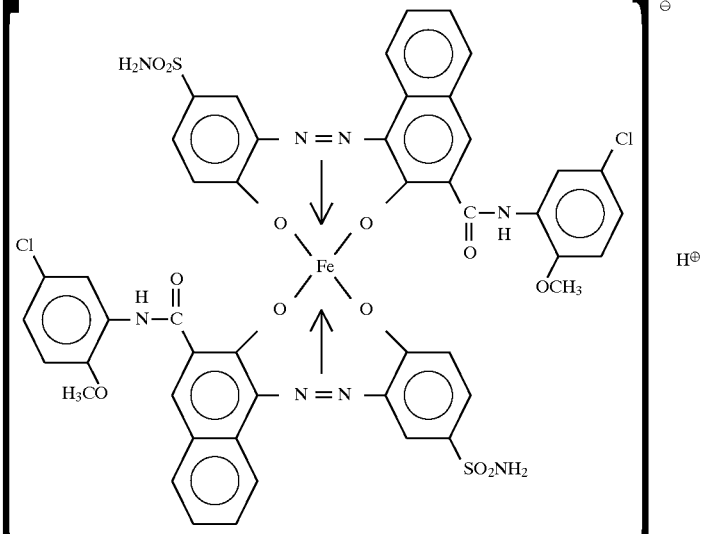
(9)
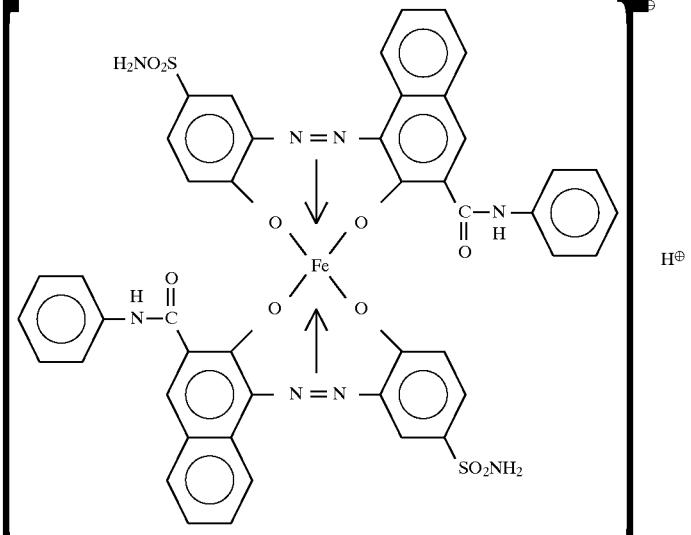

TABLE 1-continued
(10)
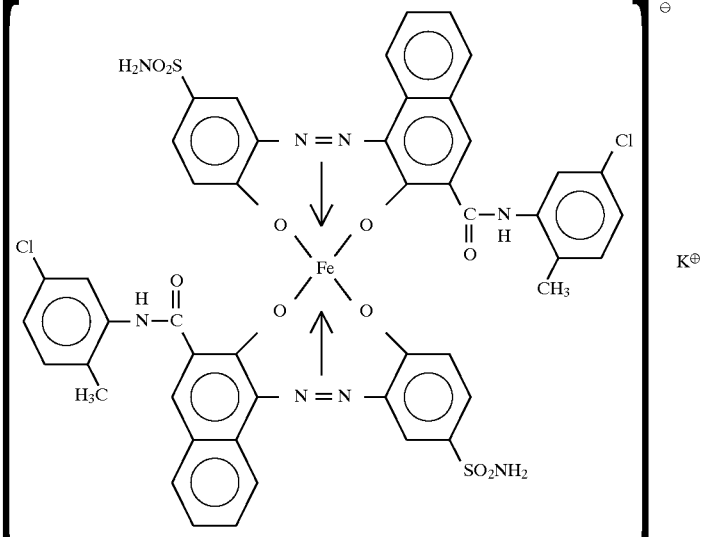
(11)
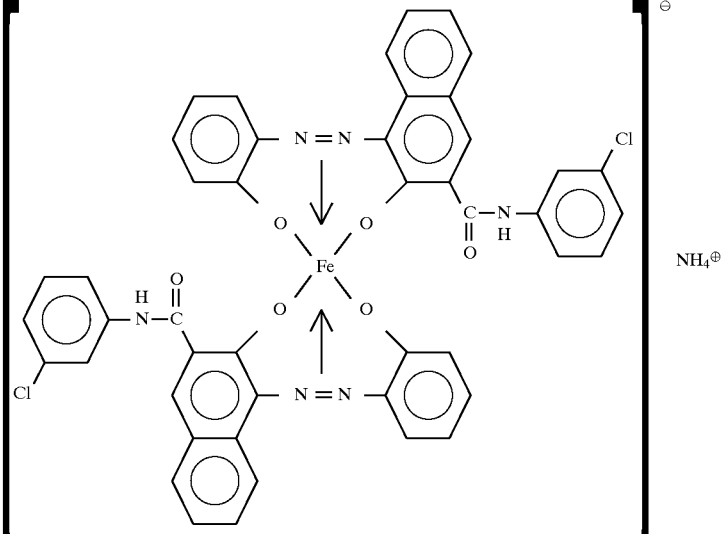
(12)
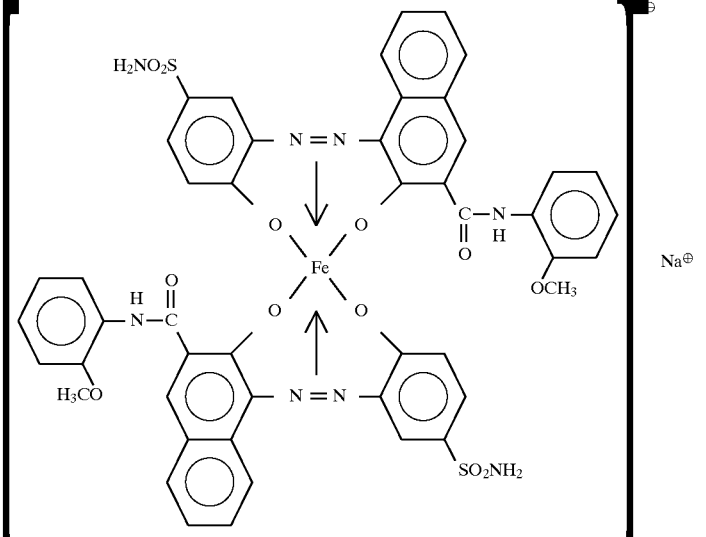

TABLE 1-continued
(13)
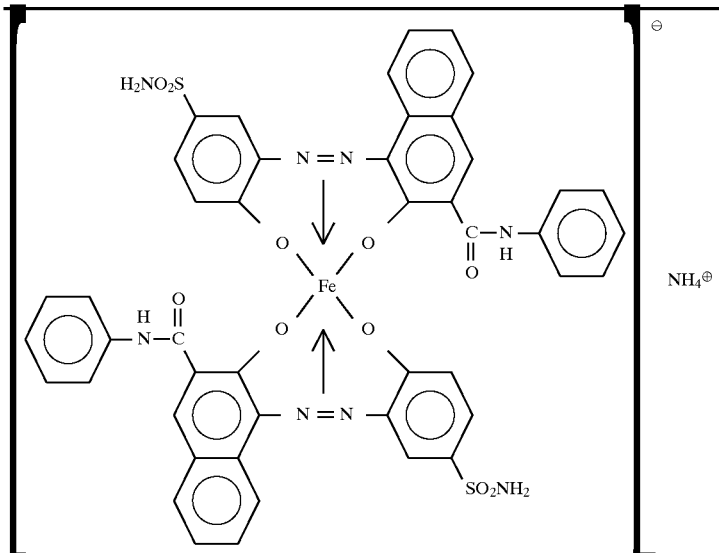
(14)
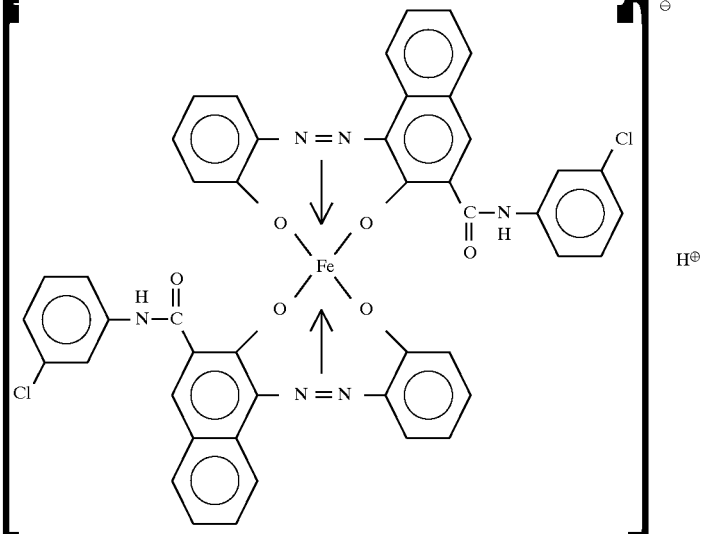
(15)
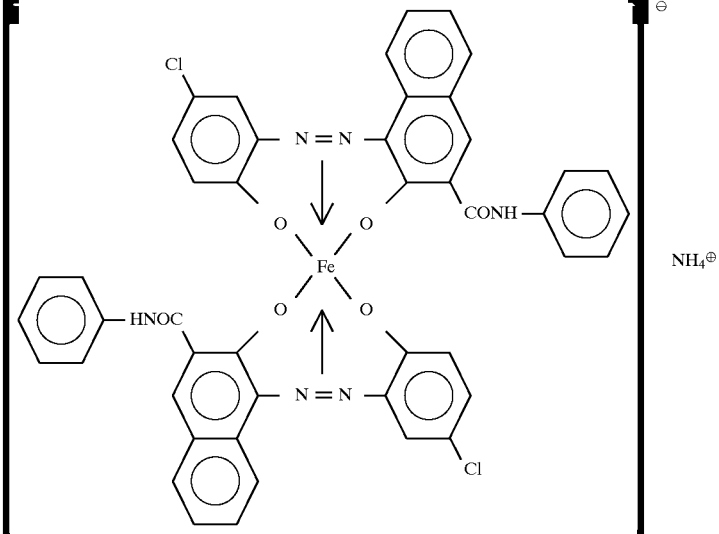

For example, the manufacturing method is as follows:

(1) mixing a binder resin, a metal-containing azo dye and a metal oxide in a mixer, if desired, together with auxiliary agents, such as a releasing agent and a coloring agent;

(2) melting and kneading the mixture in a kneader, such as a two-roller mill, an extruder or the like;

(3) pulverizing the kneaded mixture after cooling and then classifying the resultant particles to obtain toner having a desired particle diameter distribution.

Suitable coloring agents for use in the toner of the present invention include the known pigments and dyes. Specific examples of the pigments and dyes are as follows but are not limited to:

carbon black, iron black, ultramarine, Nigrosine, Aniline Blue, chalco Oil Blue, Du Pont Oil Red, Quinoline Yellow, Methylene Blue chloride, Phthalocyanine Blue, Phthalocyanine Green, Rhodamine 6C Lake, quinacridone, Malachite Green, Hansa Yellow G, Benzidine Yellow, Malachite Green hexalate, Oil Black, Azo Oil Black, Rose Bengale, monoazo dyes, disazo dyes, trisazo dyes and mixtures thereof.

The preferred content of the coloring agent may range from about 1 to about 20 parts, and more preferably from about 5 to about 15 parts, by weight per 100 parts by weight of the binding resin.

Suitable binder resins for use in the toner of the present invention include the known resins. Specific examples of the resins which may be employed individually or in combination are as follows but are not limited to:

homopolymers and copolymers of styrene and styrene derivatives, such as polystyrene, poly-p-chlorostyrene, polyvinyl toluene, styrene-p-chlorostyrene copolymers and styrene-vinyl toluene copolymers;

styrene-acrylate copolymers, such as styrene-methyl acrylate copolymers, styrene-ethyl acrylate copolymers and styrene-butyl acrylate copolymers;

styrene-methacrylate copolymers, such as styrene-methyl methacrylate copolymers, styrene-ethyl methacrylate copolymers and styrene-butyl methacrylate copolymers;

styrene copolymers, such as styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other polymers, such as polymethyl methacrylate, polybutylmethacrylate, polyvinyl chloride, polyvinyl acetate, polyethylene, polypropylene, polyester, polyvinyl butyral, polyacrylate, rosin, modified rosin, terpene resins, phenol resins, aliphatic hydrocarbon resins, chlorinated paraffin and paraffin wax.

The toner of the present invention may include, if desired, toner fluidity improving agents. Suitable toner fluidity improving agents, which have a specific surface area greater than 50 $m^2$, include silica, titanium oxide and aluminum oxide. Specific examples of the toner fluidity improving agent include, for example, Aerosil R972 manufactured by Nippon Aerosil Co., Titanium Oxide P-25 and Aluminum Oxide C, both of which are manufactured by Degussa A.G.

The toner of the present invention may also include abrasives such as silicon carbide, lubricants such as metal salts of fatty acids and particles having a particle diameter of 0.1 to 2 $\mu$m.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following compounds were mixed in a Henschel mixer and then melted and kneaded in a roll mill for about half an hour at temperatures between 130° C. and 140° C. to form toner according to the present invention.

| | |
|---|---|
| styrene-n-butyl methacrylate copolymer | 100 |
| low molecular weight polypropylene (Viscole 660P, manufactured by Sanyo Chemical Industries Ltd.) | 5 |
| magnetite (BL200, manufactured by Titan Kogyo K. K.) | 20 |
| carbon black | 4 |
| metal-containing azo dye (compound No. (4)) | 2 |

The kneaded mixture was rolled to be cooled, pulverized in a fine grinder and subjected to air classification treatment. Thus, black colored host particles having a weight-average particle diameter of 7.5 $\mu$m were obtained. Further, one (1.0) part of a hydrophobic silica powder (R972, manufactured by Nippon Aerosil Co.) was blended with 100 parts of the black colored host particles mentioned above, thus black colored toner was obtained.

The obtained toner was set in a developing unit of the type shown in FIG. 1 to obtain an image. The surface layer of the developing roller was made of a urethane rubber. The developed images had good image qualities which were maintained after 10,000 images were developed. In addition, toner film formation on the developing roller in the developing unit was not observed after 10,000 images were developed. Recovery of the toner at a cleaning section of the developing unit was 15%. The recovery of the toner was measured by the following equation:

$$\text{recovery of toner}=\{(\text{a total weight of the recovered toner at the cleaning section})/(\text{a total weight of expended toner})\}\times 100(\%).$$

The results of the evaluation of the toner are shown in Table 2.

Example 2

The procedures for preparation and evaluation of the toner in Example 1 were repeated except that the formulation of the toner was replaced with the following formulation, the weight-average particle diameter of the blue colored host particles was 8.0 $\mu$m, the hydrophobic silica powder was H-2000 manufactured by Hoechst AG. and the surface layer of the developing roller was made of an NBR rubber.

| | |
|---|---|
| styrene-n-butyl methacrylate copolymer | 100 |
| $TiO_2$ | 13 |
| metal-containing azo dye (compound No. (2)) | 2 |
| Phthalocyanine Blue | 4 |

The developed images had good image qualities which were maintained after 10,000 images were developed. In addition, toner film formation on the developing roller was not observed after 10,000 images were developed.

Example 3

The procedures for preparation and evaluation of the toner in Example 1 were repeated except that the formulation of the toner was replaced with the following formulation, the weight-average particle diameter of the black colored host particles was 7.0 μm and the surface layer of the developing roller was made of an NBR rubber.

| | |
|---|---|
| styrene-n-butyl methacrylate copolymer | 100 |
| $SiO_2$ | 45 |
| metal-containing dyes (compound No. (3)) | 2 |
| carbon black | 5 |

The developed images had good image qualities which were maintained after 10,000 images were developed. Toner film formation on the developing roller was not observed after 10,000 images were developed.

Example 4

The procedures for preparation and evaluation of the toner in Example 1 were repeated except that the formulation of the toner was replaced with the following formulation and the hydrophobic silica powder was TS-720 manufactured by Cabot Corp.

| | |
|---|---|
| polyester resin | 100 |
| carnauba wax | 5 |
| $Mn_2O_3$ | 16 |
| carbon black | 3 |
| metal-containing azo dye (compound No. (8)) | 2 |

The developed images had good image qualities which were maintained after 10,000 images were developed. Toner film formation on the developing roller was not observed.

Example 5

The procedures for preparation and evaluation of the toner in Example 1 were repeated except that the formulation of the toner was replaced with the following formulation, the hydrophobic silica powder was ZD-30S, manufactured by Tokuyama Corp. and the surface layer of the developing roller was made of a silicone rubber.

| | |
|---|---|
| polyester resin | 100 |
| carnauba wax | 5 |
| $Fe_2O_3$ | 40 |
| metal-containing azo dye (compound No. (14)) | 2 |

In this embodiment, although a coloring agent was not employed, a proper image density was obtained because the metal oxide, i.e., ferric oxide, was colored black.

The developed images had good image qualities which were maintained after 10,000 images were developed. Toner film formation on the developing roller was not observed after 10,000 images were developed.

Example 6

The procedures for preparation and evaluation of the toner in Example 1 were repeated except that the formulation of the toner was replaced with the following formulation and the hydrophobic silica powder was TG-308F manufactured by Cabot Corp.

| | |
|---|---|
| polyester resin | 100 |
| carnauba wax | 5 |
| $Fe_2O_3$ | 15 |
| carbon black | 2 |
| metal-containing azo dye (Bontoron S-34, manufactured by Hodogaya Chemical Co. Ltd.) | 0.3 |

The developed images had good image qualities which were maintained after 10,000 images were developed. Toner film formation on the developing roller was not observed after 10,000 images were developed.

Example 7

The procedures for preparation and evaluation of the toner in Example 1 were repeated except that the formulation of the toner was replaced with the following formulation and the surface layer of the developing roller was made of an EPDM (ethylene-propylene-diene-methylene) rubber.

| | |
|---|---|
| styrene-n-butyl methacrylate copolymer | 100 |
| low molecular weight polypropylene | 5 |
| $Cr_2O_3$ | 33 |
| metal-containing azo dye (compound No. (1)) | 2 |
| carbon black | 7 |

The developed images had good image qualities which were maintained after 10,000 images were developed. Toner film formation on the developing roller was not observed after 10,000 images were developed.

Example 8

The procedures for preparation and evaluation of the toner in Example 1 were repeated except that the formulation of the toner was replaced with the following formulation.

| | |
|---|---|
| styrene-n-butyl methacrylate copolymer | 100 |
| low molecular weight polypropylene | 5 |
| magnetite (EPT500, manufactured by Toda Kogyo Corp.) | 25 |
| metal-containing azo dye (Spilon Black TRH, manufactured by Hodogaya Chemical Co. Ltd.) | 1 |

In this embodiment, although a coloring agent was not employed, a proper image density was obtained because the metal oxide, i.e., magnetite, was colored black.

The developed images had good image qualities which were maintained after 10,000 images were developed. Toner film formation on the developing roller was not observed after 10,000 images were developed.

Example 9

The procedures for preparation and evaluation of the toner in Example 1 were repeated except that the formulation of the toner was replaced with the following formulation and the weight-average particle diameter of the black colored host particles was 8.0 μm.

| | |
|---|---|
| styrene-n-butyl methacrylate copolymer | 100 |
| ZnO | 13 |

-continued

| | |
|---|---|
| metal-containing azo dye (compound No. (3)) | 3 |
| carbon black | 10 |

The developed images had good image qualities which were maintained after 10,000 images were developed. Toner film formation on the developing roller was not observed after 10,000 images were developed.

Example 10

The procedures for preparation and evaluation of the toner in Example 1 were repeated except that the formulation of the toner was replaced with the following formulation, the hydrophobic silica powder was ZD-30S manufactured by Tokuyama Corp. and the weight-average particle diameter of the black colored host particles was 7.0 $\mu$m.

| | |
|---|---|
| styrene-n-butyl methacrylate copolymer | 100 |
| $SiO_2$ | 43 |
| metal-containing azo dye (compound No. (4)) | 1 |
| carbon black | 12 |

The developed images had good image qualities which were maintained after 10,000 images were developed. Toner film formation on the developing roller was not observed after 10,000 images were developed.

Example 11

The procedures for preparation and evaluation of the toner in Example 1 were repeated except that the formulation of the toner was replaced with the following formulation.

| | |
|---|---|
| polyester resin | 100 |
| carnauba wax | 5 |
| $Mn_2O_3$ | 14 |
| carbon black | 3 |
| metal-containing azo dye (compound No. (2)) | 3 |

The developed images had good image qualities which were maintained after 10,000 images were developed. Toner film formation on the developing roller was not observed after 10,000 images were developed.

Example 12

The procedures for preparation and evaluation of the toner in Example 1 were repeated except that the formulation of the toner was replaced with the following formulation.

| | |
|---|---|
| polyester resin | 100 |
| carnauba wax | 5 |
| $Fe_2O_3$ | 33 |
| metal-containing azo dye (Pro Toner Charge Control Agent 7, manufactured by Zeneca Colours.) | 0.5 |

In this embodiment, although a coloring agent was not employed, a proper image density was obtained because the metal oxide, i.e., ferric oxide, was colored black.

The developed images had good image qualities which were maintained after 10,000 images were developed. Toner film formation on the developing roller was not observed after 10,000 images were developed.

Example 13

The procedures for preparation and evaluation of the toner in Example 1 were repeated except that the formulation of the toner was replaced with the following formulation.

| | |
|---|---|
| polyester resin | 100 |
| carnauba wax | 5 |
| $Fe_2O_3$ | 18 |
| carbon black | 2 |
| Phthalocyanine Blue | 1 |
| metal-containing azo dye (compound No. (15)) | 0.8 |

The developed images had good image qualities which were maintained after 10,000 images were developed. Toner film formation on the developing roller was not observed after 10,000 images were developed.

Example 14

The procedures for preparation and evaluation of the toner in Example 1 were repeated except that the formulation of the toner was replaced with the following formulation.

| | |
|---|---|
| styrene-n-butyl methacrylate copolymer | 100 |
| low molecular weight polypropylene | 5 |
| $Cr_2O_3$ | 33 |
| metal-containing azo dye (compound No. (5)) | 1 |
| carbon black | 7 |

The developed images had good image qualities which were maintained after 10,000 images were developed. Toner film formation on the developing roller was not observed after 10,000 images were developed.

Comparative Example 1

The procedures for preparation and evaluation of the toner in Example 1 were repeated except that the formulation of the toner was replaced with the following formulation.

| | |
|---|---|
| styrene-n-butyl methacrylate copolymer | 100 |
| low molecular weight polypropylene | 5 |
| carbon black | 11 |
| metal-containing azo dye (Bontron E-84 which is zinc salicylate manufactured by Orient Chemical Industries Co. Ltd.) | 2 |

An image density of the developed images was 0.8 which was relatively low as compared to Examples 1 to 14. In addition, toner film formation was observed on the developing roller and toner scattering was also observed in the developing unit after 10,000 images were developed.

Comparative Example 2

The procedures for preparation and evaluation of the toner in Example 1 were repeated except that the formulation of the toner was replaced with the following formulation and the surface of the developing roller was made of a urethane rubber.

| | |
|---|---|
| styrene-n-butyl methacrylate copolymer | 100 |
| low molecular weight polypropylene | 5 |
| $SiO_2$ | 20 |
| carbon black | 2 |

-continued

| | |
|---|---|
| Phthalocyanine Blue | 4 |
| a resin type charge controlling agent (Acrybase FCA-1001-NS, manufactured by Fujikura Kasei Co. Ltd.) | 3 |

Although the initial developed image had high image density of 1.4 without fouling of the background of the image, the image density dropped to 1.1 and toner film formation and toner scattering were observed after 10,000 images were developed.

Comparative Example 3

The procedures for preparation and evaluation of the toner in Example 1 were repeated except that the formulation of the toner was replaced with the following formulation and the surface of the developing roller was made of NBR rubber.

| | |
|---|---|
| styrene-n-butyl methacrylate copolymer | 100 |
| low molecular weight polypropylene | 5 |
| $Fe_3O_4$ | 25 |
| carbon black | 11 |
| a negative charge controlling agent (Bontron E-84 which is zinc salicylate manufactured by Orient Chemical Industries Co. Ltd.) | 3 |

Although the initial developed image had high image density of 1.4 without fouling of the background of the image, toner film formation and toner scattering were observed after 10,000 images were developed.

TABLE 2

| | | image qualities after developing 10,000 images | | | |
|---|---|---|---|---|---|
| | initial image quality image density | image density | toner film formation | toner scattering | toner recovery (%) |
| Example 1 | 1.4 | 1.4 | No | No | 15 |
| Example 2 | 1.4 | 1.4 | No | No | 12 |
| Example 3 | 1.4 | 1.4 | No | No | 17 |
| Example 4 | 1.4 | 1.4 | No | No | 14 |
| Example 5 | 1.4 | 1.4 | No | No | 16 |
| Example 6 | 1.4 | 1.4 | No | No | 14 |
| Example 7 | 1.4 | 1.4 | No | No | 13 |
| Example 8 | 1.4 | 1.4 | No | No | 13 |
| Example 9 | 1.4 | 1.4 | No | No | 18 |
| Example 10 | 1.4 | 1.4 | No | No | 19 |
| Example 11 | 1.4 | 1.4 | No | No | 16 |
| Example 12 | 1.4 | 1.4 | No | No | 15 |
| Example 13 | 1.4 | 1.4 | No | No | 13 |
| Example 14 | 1.4 | 1.4 | No | No | 16 |
| Comparative Example 1 | 1.4 | 0.8 | Yes | Yes | 40 |
| Comparative Example 2 | 1.4 | 1.1 | Yes | Yes | 33 |
| Comparative Example 3 | 1.2 | 1.2 | Yes | Yes | 29 |

The results in Table 2 clearly indicate that the toner of the present invention exhibits good image qualities without toner film formation on the developing roller and toner scattering in the developing unit. In addition, the toner recovery of the toner of the present invention is less than that of the comparative toner. The toner which includes both a charge controlling agent other than metal-containing azo dyes and a metal oxide cannot prevent the developing roller from toner film formation even when the content of the metal oxide in the toner is from 10 to 30% by weight.

Obviously, additional modifications and variations of the present invention are possible in light of the above teachings. It is therefore to be understood that within the scope of the appended claims the invention may be practiced other than as specifically described herein.

This application is based on Japanese Patent Applications No. 08-132732 and 08-205404, filed on Apr. 30, 1996, and Jul. 16, 1996, respectively, the entire contents of which are herein incorporated by reference.

What is claimed is:

1. A dry toner comprising host particles each including a metal oxide and a metal-containing azo dye.

2. The dry toner of claim 1, wherein the metal oxide is comprised in the toner in an amount of from about 10 to about 30 parts by weight per 100 parts by weight of the toner.

3. The dry toner of claim 1, wherein the metal-containing azo dye has the formula (i):

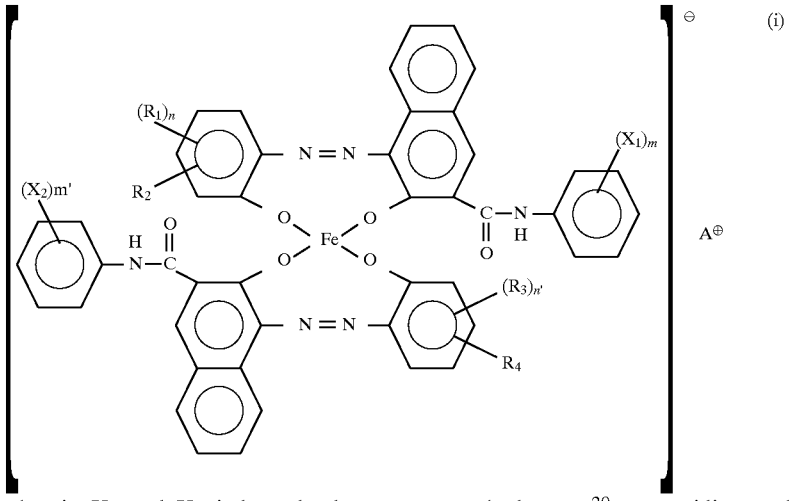

(i)

wherein $X_1$ and $X_2$ independently represent a hydrogen atom, a lower alkyl group, a lower alkoxy group, a nitro group or a halogen atom; m is 1,2 or 3; m' is 1, 2 or 3; $R_1$ and $R_3$ independently represent a hydrogen atom, an alkyl group having carbon atoms of from 1 to 18, an alkenyl group, a sulfone amide group, a sulfonic acid group, a carboxyl ester group, a hydroxy group, an alkoxy group having carbon atoms of from 1 to 18, an acetyl amino group, a benzoyl amino group or a halogen atom; n is 1,2 or 3; n' is 1, 2 or 3; $R_2$ and $R_4$ independently represent a hydrogen atom or a nitro group; and $A^+$ represents a hydrogen ion, a sodium ion, a potassium ion or an ammonium ion.

4. The dry toner of claim 1, wherein the metal-containing azo dye is comprised in the toner in an amount of from about 0.1 to about 5.0 parts by weight per 100 parts by weight of the toner.

5. The dry toner of claim 1, wherein the toner has a tablet density of from about 1.20 to about 1.40 g/cm$^3$.

6. The dry toner of claim 1, wherein the metal oxide comprises at least one oxide selected from the group consisting of iron oxide, manganese oxide and ferrite.

7. The dry toner of claim 1, wherein the toner has a weight-average particle diameter of from about 3 to about 9 $\mu$m.

8. A one component developer developing method comprising the steps of:

providing a dry toner comprising host particles each including a metal oxide and a metal-containing azo dye;

providing a developing unit including a toner carrying member, a toner layer regulating member and a toner supplying member wherein the toner layer regulating member contacts the toner carrying member;

forming a thin toner layer on the toner carrying member; and developing an electrostatic latent image on an electrostatic latent image carrying member with the thin toner layer to obtain a toner image.

9. The one component developer developing method of claim 8, wherein the metal oxide is comprised in the toner in an amount of from about 10 to about 30 parts by weight per 100 parts by weight of the toner.

10. The one component developer developing method of claim 8, wherein the toner supplying member also contacts the toner carrying member.

11. The one component developer developing method of claim 8, wherein the metal-containing azo dye of the toner has the formula (i);

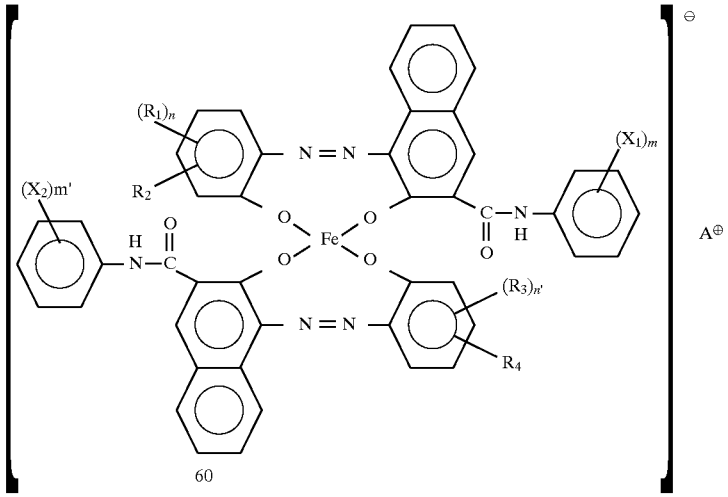

(i)

wherein $X_1$ and $X_2$ independently represent a hydrogen atom, a lower alkyl group, a lower alkoxy group, a nitro group or a halogen atom; m is 1, 2 or 3; m' is 1, 2 or 3; $R_1$ and $R_3$ independently represent a hydrogen atom, an alkyl group having carbon atoms of from 1 to 18, an alkenyl group, a sulfone amide group, a sulfonic acid group, a carboxyl ester group, a hydroxy group, an alkoxy group having carbon atoms of from 1 to 18, an acetyl amino group, a benzoyl amino group or a halogen atom; n is 1, 2 or 3; n' is 1, 2 or 3; $R_2$ and $R_4$ independently represent a hydrogen atom or a nitro group; and $A^+$ represents a hydrogen ion, a sodium ion, a potassium ion or an ammonium ion.

12. The one component developer developing method of claim 8, wherein the metal-containing azo dye is comprised in the toner in an amount of from about 0.1 to about 5.0 parts by weight per 100 parts by weight of the toner.

13. The one component developer developing method of claim 8, wherein the metal oxide comprises at least one oxide selected from the group consisting of iron oxide, manganese oxide and ferrite.

14. The one component developer developing method of claim 8, wherein the toner has a weight-average particle diameter of from about 3 to about 9 $\mu$m.

15. A dry toner for use in a one component dry developer developing method, comprising host particles each include a binder resin, a metal oxide, and a metal-containing azo dye, said oxide and said dye being present in amounts effective to prevent toner film formation and toner scattering after development of 10,000 images.

16. The dry toner of claim 15, wherein said metal oxide is colored and serves as a coloring agent for the toner.

17. The dry toner of claim 15, further including a coloring agent.

18. The dry toner of claim 15, wherein said oxide is present in an amount of about 10 to about 30 parts by weight, and said dye is present in an amount of about 0.1 to about 5.0 parts by weight, in 100 parts by weight of the toner.

* * * * *